United States Patent [19]

Jartoux

[11] Patent Number: 4,976,078

[45] Date of Patent: Dec. 11, 1990

[54] CABLE ANCHORING DEVICES

[75] Inventor: Pierre Jartoux, Epernon, France

[73] Assignee: Freyssinet International (STUP), France

[21] Appl. No.: 341,014

[22] Filed: Apr. 20, 1989

[30] Foreign Application Priority Data

Apr. 20, 1988 [FR] France ..... 88 05225

[51] Int. Cl.[5] ..... E04C 5/12

[52] U.S. Cl. ..... 52/223 L; 52/223 R

[58] Field of Search ..... 52/223 R, 223 L, 230

[56] References Cited

U.S. PATENT DOCUMENTS

| | | | |
|---|---|---|---|
| 2,217,560 | 10/1940 | Michon | 52/223 L |
| 2,245,316 | 6/1941 | Amsler | 52/223 L |
| 2,804,674 | 9/1957 | Long | 52/223 L |
| 2,834,081 | 5/1958 | Stump, Jr. | 52/223 L |
| 3,405,490 | 10/1968 | LaMarr | 52/223 R |

FOREIGN PATENT DOCUMENTS

| | | | |
|---|---|---|---|
| 697667 | 11/1979 | U.S.S.R. | 52/223 L |

*Primary Examiner*—Richard E. Chilcot, Jr.
*Attorney, Agent, or Firm*—Larson and Taylor

[57] ABSTRACT

A device is provided for the anchorage of a stretched cable (2,4) on a bearing surface through which this cable passes, comprising a U-shaped body (8) adapted to straddle a section of the cable, the arms of which body are extended by flanges (9) directed towards each other, and a peg (12) adapted to be housed in the U-shaped opening of said body so as to bear against the flanges of its arms, the assembly of the body and the peg being designed so as to define a truncated cone shaped housing for a split truncated cone shaped jaw (14), known per se, adapted for clamping said section.

4 Claims, 2 Drawing Sheets

CABLE ANCHORING DEVICES

The invention relates to devices for the anchorage of stretched cables of a general cylindrical contour on solid masonry masses, generally made from concrete, through which these cables pass.

Its purpose is essentially to make these devices such that they may be used even with cables whose section leaving the solid mass and gripped for anchorage has no free end for simple axial fitting of annular anchorage elements thereon.

Figure 1:
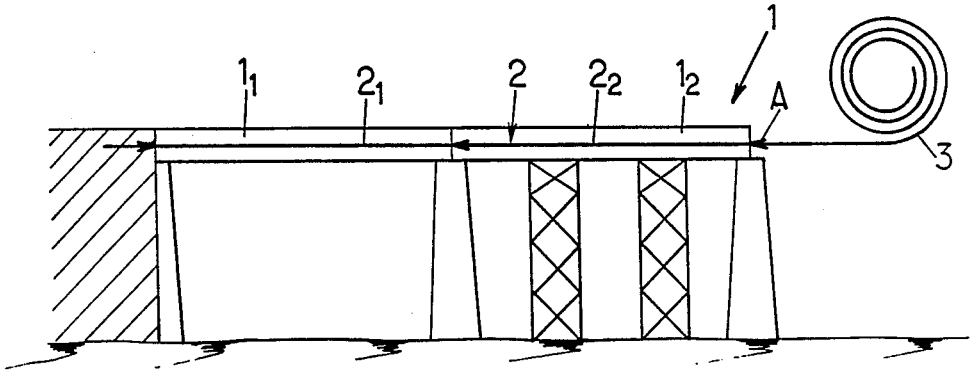

This is the case for example in the advancing construction of pre-stressed works shown schematically at 1 in FIG. 1, which works are formed of a plurality of bays $1_1$, $1_2$,...manufactured successively step by step and reinforced respectively by different successive sections $2_1$, $2_2$... of the same continuous pre-stress cable 2 ; each cable section $2_i$—the index i designating the rank of the section or of the bay considered—must be stretched after construction of the bay $1_i$ which it passes through and which it is intended to reinforce and this tension must be maintained by an anchorage device A bearing against this bay and clamping the outgoing end of the section. Now, the cable portion which is then outside the constructed work portion is still relatively long and generally rolled in a reel 3, so that its end is inaccessible.

Figure 2:
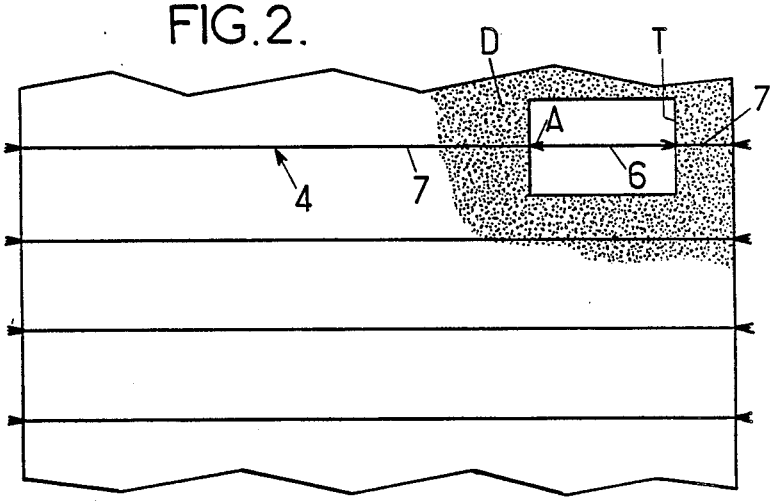
Figure 3:
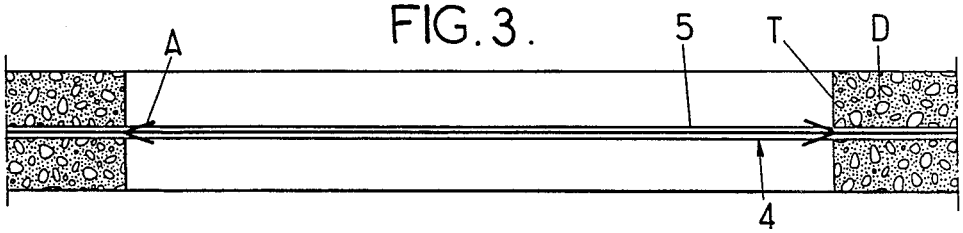

This is also the case when forming an opening or cavity T—shown respectively in a plan view in FIG. 2 and in a partial vertical section in FIG. 3—in a concrete slab D reinforced by pre-stress cables 4 of a non adherent type, i.e. housed with interpositioning of grease in sheaths 5, e.g. for installing a lift or staircase well in such an opening : it must be possible to remove the portions 6, of these cables 4, which pass through opening T without their portions 7 remaining inside the slab being disengaged from this slab or even slackened with the danger of weakening said slab.

The anchorage devices of the invention make it possible to obtain the above-mentioned result because they are mounted "astride" the cable sections to be anchored.

For this they have, in a way known per se, a truncated cone shaped housing for a split truncated cone shaped jaw adapted to surround and clamp a section of the cable to be anchored and they are essentially characterized in that they comprise a U-shaped body adapted for straddling said section, in which body the arms are extended by flanges directed towards one another, and a peg adapted to be housed in the U-shaped opening of said body so as to bear against the flanges of its arms, the assembly of the body and the peg being designed so as to define the truncated cone shaped housing.

To use such an anchorage device, it is placed about the cable section leaving the work—i.e. in the immediate proximity of this work so as to bear axially thereagainst —by radial straddling of said section by the U-shaped body followed by axial insertion of the peg and of the jaw, the desired anchorage then being obtained by radially clamping the jaw about the cable section by axially urging the jaw in the direction of the work, the narrowed portion of said jaw being disposed axially on the same side as said work.

In preferred embodiments, recourse is further had to one/or other of the following arrangements :

the U-shaped body is extended at one of its axial ends by a transverse base split in line with the U-shaped opening of said body and ribs are interposed between said body and the base so as to oppose any widening of said U-shaped opening, the mutual bearing faces of the peg and of the flanges of the arms of the U-shaped body extend along a surface shaped so that the overall pressure exerted by the peg on each flange does not force the flanges to move mutually apart, the shape of the bearing faces according to the preceding paragraph is such that the overall pressure exerted by the peg on each flange tends to draw the two flanges mutually closer together.

Apart from these main arrangements, the invention comprises certain other arrangements which are preferably used at the same time and which will be more explicitly discussed hereafter. In the following, a preferred embodiment of the invention will be described with reference to FIGS. 4 and 5, in a way which is of course in no wise limitative.

Figure 5:
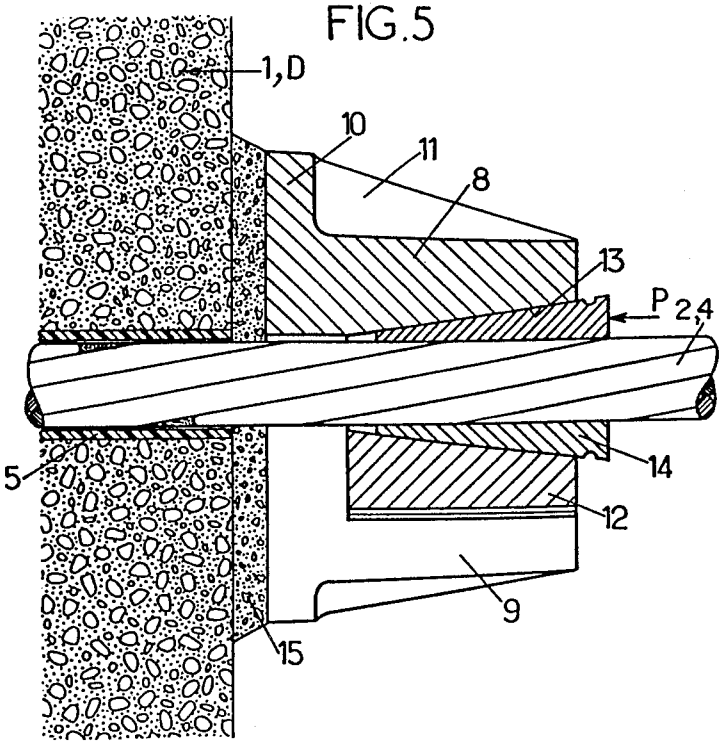
Figure 4:
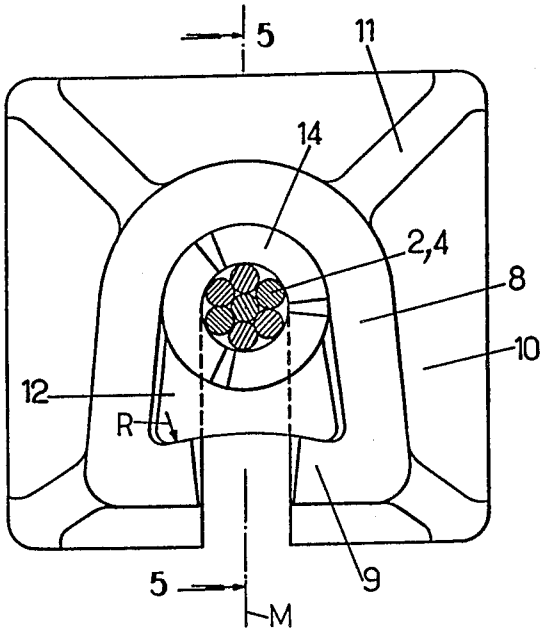

These FIGS. 4 and 5 show respectively in an end view and in an axial section through V—V of FIG. 4, an anchorage device formed in accordance with the invention. Generally this anchorage device is adapted so as to be able to fit astride a running portion of a pre-stress cable, for surrounding and strongly clamping this portion, which forms an end of a stretched section of said cable or is intended to form subsequently such an end.

This device comprises :

a rigid U-shaped body 8 adapted to straddle the cable section $2_i$ or 6 to be anchored radially, the two arms of this U being extended by flanges 9 oriented towards each other; and a peg 12 adapted to be housed in the opening of the U formed by body 8 by bearing against the internal faces of flanges 9.

Body 8 is extended by a transverse pressure distributing base 10 split in line with the opening of said body and it is reinforced by ribs 11 connecting the base to the body.

As can be seen in FIG. 4, two of the ribs 11 bear respectively on the roots of flanges 9 so as to oppose their mutual movement apart.

Body 8 and peg 12 are designed so as to define together an internal truncated cone shaped housing 13 for a split truncated cone shaped jaw 14, the small diameter end of this housing being situated on the same side as base 10.

Furthermore, the mutual bearing faces of peg 12 against flanges 9 are designed so that the overall pressure exerted by the peg on each flange, during clamping of the cable by the jaw, does not tend to move these flanges away from each other.

For this, each of these faces extends generally along a cylindrical surface whose generatrices are parallel to the axis of the section to be anchored and whose directrix is:

either a straight line segment perpendicular to the median plane M of the U defined by body 8, or a section inclined with respect to the above straight line segment, as can be seen in FIG. 4, i.e. designed so that the resultant R of the clamping pressure exerted on said section, which resultant is oriented perpendicularly to this section towards the corresponding flange 9, is directed towards the plane M which has just been defined and not in the opposite direction.

Jaw 14 is formed in a way known per se of three identical keys defining together a cylindrical internal face adapted for jointingly surrounding the cable section to be anchored.

The way to use this anchorage device is the following.

The section (2,4) to be anchored is first of all bared of its sheath 5, if it was initially sheathed, after which the thus bared section is cleaned of grease if necessary.

Then a concrete chocking and sealing sole-piece 15 is provided on the external surface of the work (1,D) which the section to be anchored passes through and which is intended to serve as anchorage surface.

Then, an anchorage device without its peg is placed astride the portion of the section to be anchored, just projecting axially out of the sole-piece 15, and the base 10 of this device is applied against the sole-piece.

Then, the following are introduced axially :

peg 12 between the cable section straddled by the anchorage device and the flanges 9 of this device, the keys forming the split jaws 14 in the annular housing formed between the cable section and the facing truncated cone shaped faces of the anchorage device so that said jaw 14 surrounds said section.

The dimensions of this jaw 14 are chosen such that its large base projects axially outside said housing at the end of its introduction.

It is then sufficient to apply an axial thrust P against this large base so as to obtain the desired anchorage.

For this, a thrust apparatus is used adapted so as to be able to straddle the strand, of the cable considered, leaving the work.

In an embodiment applicable to the advancing constructions shown in FIG. 1 schematically, such a thrust apparatus bears axially in two opposite directions respectively on cable 2 and on the work 1 reinforced by this cable, via the jaw 14 and the body-peg 8-12 assembly, and said apparatus comprises for example two parallel jacks disposed on each side of said cable, which jacks are joined together by split frames straddling the cable.

In another embodiment applicable to removal of a stretched cable section 6 passing through a cavity T, such as shown in FIGS. 2 and 3, the thrust apparatus bears in two opposite directions on the two facing faces, of the cavity, through which the stretched cable to be cut passes or more precisely on the jaws 14 of two anchorage devices mounted in the immediate proximity of these two faces., and this apparatus advantageously comprises a set of at least two wedges adapted to slide transversely against each other and split so as to straddle section 6, their mutual transverse movements being controlled by an appropriate jack.

Following which and whatever the embodiment adopted, a cable anchorage device is finally obtained whose construction and use are sufficiently clear from the foregoing.

The device has a number of advantages with respect to those known heretofore and in particular that of being very readily fitted astride a cable section to be anchored whose free end is not accessible for fitting of an annular piece.

It may also be noted that, in the case of advancing constructions, the anchorage devices proposed may be recovered as the work advances, because the successive tensioning of the contiguous sections $2_i$ of cable 2 result in equalizing the tension on each side of the previously positioned anchorage devices, which makes it possible to release the corresponding jaws 14 : it is then sufficient to disengage these jaws axially, then peg 12—if, as it is assumed, the space available is sufficient for this purpose—to make it possible to disengage body 8 radially.

As is evident and as it is moreover clear from the foregoing, the invention is in no wise limited to those of its modes of application and embodiments which have been more especially considered : it embraces, on the contrary, all the variants thereof.

I claim:

1. Device for the anchorage of a stretched cable (2, 4) of a general cylindrical contour on a bearing surface (1, D) through which this cable passes, said device having a truncated cone shaped housing for receiving a split truncated cone shaped jaw (14) adapted to surround and clamp a section of said cable, characterized in that said device comprises a U-shaped body (8) including two opposed arms, said body defining a U-shaped opening between said arms and being adapted to straddle said section, and said arms of said body being extended by flanges (9) directed towards one another, and a peg (12) adapted to be housed in the U-shaped opening of said body so as to bear between only said flanges of said arms and a portion of said jaw (14) facing said flanges, the assembly of body and peg being designed so as to define the truncated cone shaped housing.

2. Anchorage device according to claim 1, characterized in that the U-shaped body (8) is extended at one of its axial ends by a transverse base (10) split in line with the U-shaped opening of said body and in that ribs (11) are interposed between this body and the base so as to oppose any widening of said U-shaped opening.

3. Anchorage device according to claim 1, characterized in that the mutual bearing faces of the peg (12) and of the flanges (9) of the arms of the U-shaped body (8) extend along a surface shaped so that the overall pressure exerted by the peg on each flange does not cause the flanges to move mutually away from each other.

4. Anchorage device according to claim 3, characterized in that a shape of each of the bearing faces formed between the peg (12) and the flanges (9) is such that the overall pressure exerted by the peg on each flange tends to draw the two flanges mutually together.

* * * * *